United States Patent [19]

Marek

[11] 4,052,144

[45] Oct. 4, 1977

[54] FUEL COMBUSTOR

[75] Inventor: Cecil J. Marek, Shaker Heights, Ohio

[73] Assignee: The United States of America as represented by the Administrator of the National Aeronautics and Space Administration, Washington, D.C.

[21] Appl. No.: 672,210

[22] Filed: Mar. 31, 1976

[51] Int. Cl.[2] ..... F34D 15/02; F23R 1/00

[52] U.S. Cl. ..... 431/352; 431/158; 60/39.51 R; 165/105

[58] Field of Search ..... 431/158, 157, 351, 352; 165/105; 60/253, 39.71, 39.51 R

[56] References Cited

U.S. PATENT DOCUMENTS

| | | | |
|---|---|---|---|
| 3,153,323 | 10/1964 | Hamm | 60/39.71 |
| 3,429,122 | 2/1969 | Pravda et al. | 60/39.51 R |
| 3,593,518 | 6/1971 | Gerrard | 431/352 X |
| 3,748,853 | 7/1973 | Jones et al. | 431/173 X |
| 3,763,838 | 10/1973 | Lindsay et al. | 165/105 |
| 3,823,766 | 7/1974 | Sawyer | 60/39.51 |
| 3,921,710 | 11/1975 | Katayama | 165/105 |

*Primary Examiner*—Edward G. Favors

*Assistant Examiner*—Larry Jones

*Attorney, Agent, or Firm*—N. T. Musial; J. A. Mackin; J. R. Manning

[57] ABSTRACT

A fuel combustor comprises a chamber with air and fuel inlets and a combination gas outlet. The fuel is supplied to a vaporization zone and fuel and air are mixed in a pair of mixing chambers each exemplified by a swirl can and the resultant mixture is directed into a combustion zone within the combustor. Combustion products are exhausted, for example, into a turbine inlet.

Heat pipe means, in this case comprising a pair of heat pipes for each swirl can, are arranged each pipe with one end portion substantially in the combustion zone and the other end portion in the vaporization zone of its appropriate mixing chamber. By use of the heat pipe means some of the heat of combustion is carried back upstream into the swirl cans, to vaporize the fuel as it enters the vaporization zone in the swirl can, thereby improving vaporization and fuel mixing. Fewer pollutants are formed and complete combustion is assisted because of the improved fuel vaporization and better mixing.

3 Claims, 1 Drawing Figure

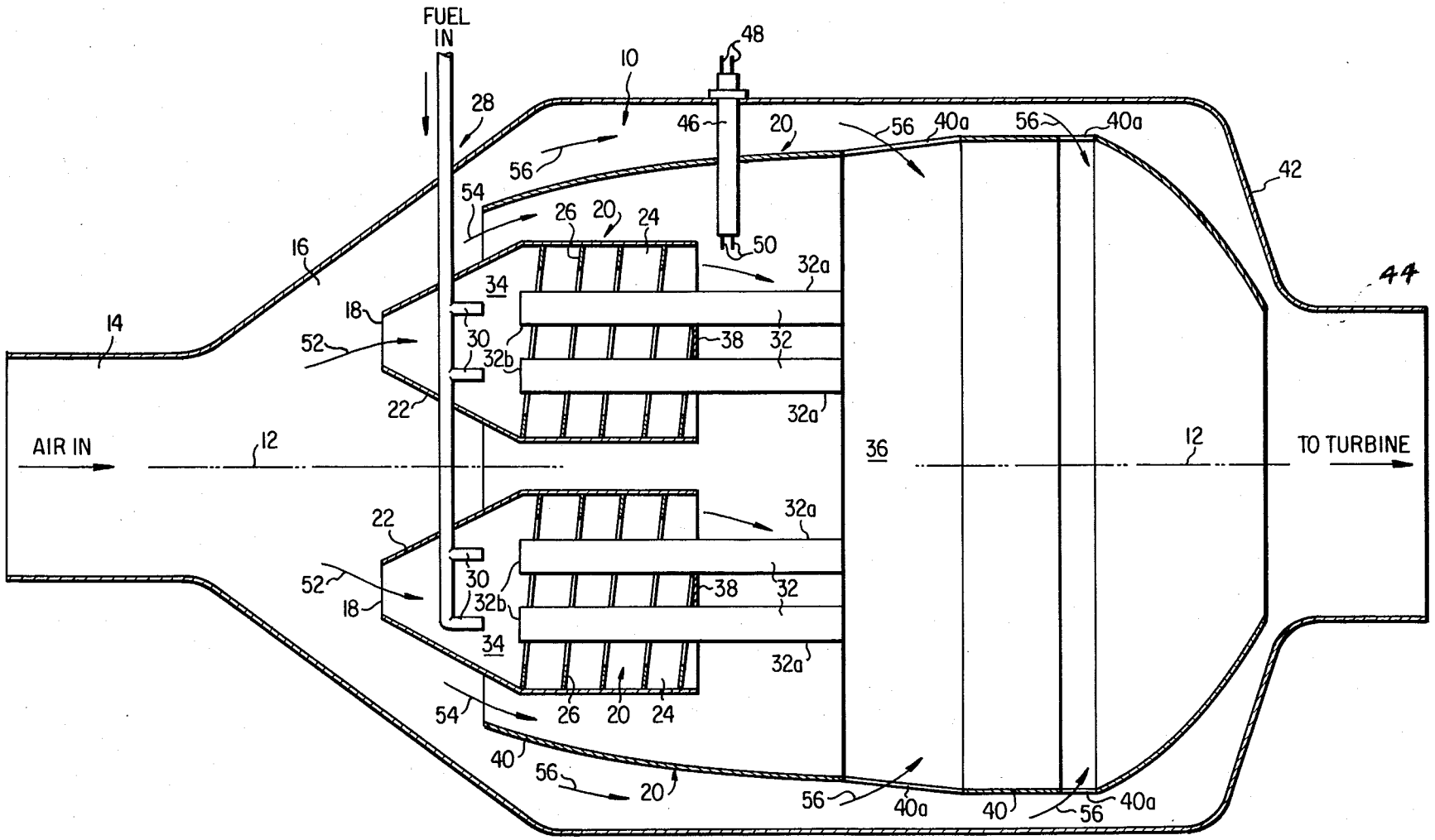
TO TURBINE
AIR IN
FUEL IN
44
42
12
40a
56
40
36
20
48
50
46
10
32a
32
38
24
26
34
30
32b
28
54
22
18
52
16
14

FUEL COMBUSTOR

The invention described herein was made by an employee of the United States government and may be manufactured and used by or for the government for governmental purposes without the payment of any royalties thereon or therefor.

BACKGROUND OF THE INVENTION

The present invention relates to combustors, and more particularly to combustors in which the fuel is vaporized for mixing and combustion with a suitable oxidant such as air. A problem with such combustors is to secure the vaporization of the fuel as it is mixed with the oxidant to enhance mixing and to ensure so far as possible complete combustion of the mixture.

The prior art suggests, for example, using a combustion chamber in which the heat of combustion of the burning fuel supplies heat of vaporization. Usually such a combustor operates at fuel rich mixtures leading to incomplete combustion. Under these conditions carbon monoxide (CO), smoke, and nitrous oxides (NOx) are formed. These compounds are undesirable pollutants.

One expedient heretofore used to assist vaporization of the fuel is to reduce the pressure in a vaporization combustion chamber through which the fuel passes. Such an expedient may now be omitted by employing the present invention. Also precombustors sometimes used in the prior art are not required with the combustor embodying the invention, thus eliminating an undesirable pressure drop.

It is therefore an object of the invention to provide an improved combustor.

Another objective of the invention is to provide a combustor which improves fuel vaporization and mixing.

SUMMARY OF THE INVENTION

According to the invention a fuel combustion chamber is provided and a fuel inlet supplying fuel to the chamber. The fuel is injected into vaporization zone and a heat pipe means is arranged to conduct heat from the combustion zone within the fuel chamber to the vaporization zone. Accordingly a portion of the heat of combustion is returned by the heat pipe means from the combustion zone to the vaporization zone thereby aiding in fuel vaporization and consequent fuel mixing and combustion.

BRIEF DESCRIPTION OF THE DRAWING

The foregoing other objects, advantages, and novel features of the invention will be more fully apparent from the following detailed description when read in connection with the sole figure of the drawing which illustrates in longitudinal cross-sectional view an embodiment of the present invention.

DESCRIPTION OF THE PREFERRED EMBODIMENT

Referring to the sole figure of the drawing, a combustor comprises wall 10 which may be in the form of a surface of revolution about an axis 12. The walls 10 are necked down at an inlet 14 thrugh which air is supplied as a source of oxidant for the combustor. In the neck portion 16 between the main body portion of the walls 10 and the inlet 14, the combustor gradually enlarges in the downstream direction. Within the neck portion 16 are the inlets 18 to a pair of swirl cans 20. Conical portions 22 of the swirl cans are enlarged in the downstream direction from inlets 18 to circularly cylindrical body portions 24. Vanes 26 are provided internally of the swirl cans 20 in the cylindrical portions 24 to swirl the incoming mixture in the downstream direction as it passes through the cans, thereby increasing the turbulence and enhancing mixing.

Alternatively, instead of the vanes 26 as shown the swirlers in the swirl cans 20 may, as an alternative (not illustrated), take the form of a set of vanes emanating from the central axis and all twisted or turned in the same sense and extending to the can walls. In this alternative form the vanes are much like the vanes of the stator of a compound turbine or like the vanes of an ordinary house fan, but stationary. Swirlers and swirl cans are in themselves known.

A fuel manifold 28 has a pair of outlets 30 for each can 20 whereby fuel is supplied near the inlets 18 of the swirl cans 20. A pair of heat pipes 32 are provided which extend from a zone which may be termed the vaporization zone 34 adjacent the fuel inlets 30 into the central portion of the chamber formed by the wall 10. Combustion occurs in this central portion which is therefore designated the combustion zone 36. Flame barriers 38 between each pair of heat pipes 32 tend to prevent the flame in the combustion chamber from reacting into the vaporization zone causing premature fuel combustion. The heat pipes 32 may carry fins (not shown) for improved heat transfer between the heat pipe walls and the surrounding area or zones.

A heat pipe in the simple form illustrated here, comprises a metallic container having on the inner surface thereof a capillary structure which is essentially saturated with a vaporizable liquid. The heat pipe acts to transfer heat efficiently from one point on its external surface to any other point by a vaporization-condensation cycle. The four general regions of the heat pipe include (all internally of the pipe) an evaporator region which transfer heat to the inflowing inner liquid, thereby vaporizing it, a vapor channel which permits vapor to flow from the evaporator to a condensor, the condensor which condenses the vapor thereby removing heat from it, and the capillary liquid transport section in which the liquid condensate flows back to the evaporator. The heat pipe essentially functions as a reflux condensor or evaporating-condensing device whch uses its internal capillary or wick section to return condensed liquid from the condensor to the evaporator. A heat pipe is a totally enclosed, simple, mechanically static device which can transport large quantities of heat over sizable distances almost isothermally, and is essentially independent of gravity. When heat is applied to the portion 32a of heat pipes 32 adjacent the combustion zone that heat is conducted quickly and readily to the other end of the heat pipe thereby providing a substantial heat flow to the other end 32b adjacent the vaporization zone. Heat pipes in themselves are well known. External vanes (not shown) on the portions where heat transfer between the pipe and the external volume is desired may be employed.

A combustor liner 40 is provided within the combustor spaced close to the walls 10 and generally parallel thereto and extending approximately from the neck 16 along a more sharply necked down portion 42 of the walls 10 leading to an outlet portion 44. The liner 40 is extended in the downstream direction to protect the wall portion 42. The liner 40 is provided with apertures 40a in the area adjacent the combustion zone. An ignitor which may comprise simply an insulating rod 46 through which pass a pair of wires 48 terminating in a pair of electrodes 50 spaced to provide a spark gap for igniting the fuel mixture to initiate combustion.

In operation fuel enters the combustor through the manifold 28 and is supplied to the vaporization zones 34. The oncoming air stream divides into portions. A first portions indicated by the arrows 52 enters the swirl cans at the inlets 18 and in its downstream flow picks up fuel in the vaporization zone 34. During operation the end portion 32a of the heat pipes 32 receives heat from the combustion zone 36 where combustion is taking place. Some of this heat is transferred by the heat pipe to the end portion 32b in the vaporization zone and warms the incoming fuel and air mixture thereby vaporizing or tending to vaporize the incoming fuel as the mixture of fuel and air travels in the downstream direction within the swirl cans 20. The mixture is swirled and mixed by the reaction against the vanes 26. The resultant increase in the turbulence of the fuel mixture tends to complete the vaporization and mixing of the fuel and the air or oxidant, and the mixture thereof burns readily as it enters the combustion zone 36. Meanwhile a second portion of the air stream as indicated by the arrows 54 passes between the swirl cans 20 and the liner 40 and thereby provides additional air or oxidant as it passes along beyond the ends of the swirl cans 20 in the downstream direction into the combustion zone. A third flow of air indicated by arrows 56 passes in the downstream direction between the liner 40 and the walls 10 and for the most part passes through apertures 40*a* to be directed toward the combustion zone 36. This third air flow together with the second air flow tends to cool the combustor liner 40. As the air flow portions indicated by arrows 54 and 56 enter the combustion chamber they tend to dilute the combustion mixture by providing an excess of oxidant thereby enhancing complete combustion and tending to reduce or eliminate pollutants.

Preheating the inlet stream in the fuel zone 34 by the energy transferred by the heat pipes 32 from the combustion zone to the vaporization zone not only promotes vaporization but the inlet stream mixture is heated. The result is an increase in the combustion stability and the combustor may be operated at a higher velocity of its inputs, and at greater heat release rate, thereby allowing for reduction in engine size and weight for an equivalent output. The operating temperature of the heat pipes at least in the area near vaporization zone 34 should be kept below the ignition temperature to prevent combustion from occuring within the vaporizer and mixer, such as within the swirl cans 20. On start up the combustor relies on air atomization until the heat pipes approach or reach operating temperature. Once operating the heat pipes 32 improve flame stability and improve the turndown ratio of the combustor.

What is claimed is:

1. A combustor comprising an air flow inlet and an outlet, a fuel supply, a plurality of mixing chambers disposed in said combustor, a fuel inlet manifold for providing fuel at respective inlets of said mixing chambers, said chambers being in the path of air from said air flow inlet, a portion of the air from said air flow inlet bypassing said mixing chambers, a plurality of heat pipes each having one portion in the path of the fuel and air as it is mixed in a respective one of said mixing chambers and another portion downstream of said mixed air fuel adjacent the zone of combustion during operation, thereby in operation to transfer heat of combustion upstream of enhance fuel vaporization and complete combustion.

2. A combustor as claimed in claim 1, said combustor having walls, and a liner between said walls and said combustion zone, said liner and air inlet being arranged so that air is supplied to a passageway between said walls and said liner.

3. A combustor as claimed in claim 2, said liner having one or more apertures arranged to supply air from said passageway to said combustion zone, thereby to supply air to a dilution zone about said combustion zone to improve combustion.

* * * * *